US005305975A

United States Patent [19]

Douglass et al.

[11] Patent Number: 5,305,975

[45] Date of Patent: Apr. 26, 1994

[54] FLAGGING APPARATUS AND METHOD

[76] Inventors: Charles L. Douglass, 1432 Pine Crescent, Kamloops, British Columbia, Canada V2C 2Z3; Bruce A. Mertz, 1212 Highridge Dr., Kamloops, British Columbia, Canada V2C 5G6

[21] Appl. No.: 972,691

[22] Filed: Nov. 6, 1992

[51] Int. Cl.[5] ..... B61L 5/12

[52] U.S. Cl. ..... 246/477; 116/281; 116/175; 116/283; 340/825.69; 340/309.2

[58] Field of Search ..... 116/173, 175, 281, 282, 116/283, 225; 246/473 R, 474, 476, 477, 478; 340/825.44, 825.69, 825.77, 309.15, 309.2, 309.3

[56] References Cited

U.S. PATENT DOCUMENTS

| | | | |
|---|---|---|---|
| 230,418 | 7/1880 | Jackson | 246/473 R |
| 287,446 | 10/1883 | Grande | 246/476 X |
| 506,175 | 10/1893 | Hanson | 246/477 |
| 708,487 | 9/1902 | Mead | 116/282 |
| 773,098 | 10/1904 | Park | 246/476 |
| 1,480,484 | 1/1924 | Wertz . | |
| 1,718,674 | 6/1929 | Wheeler | 116/283 X |
| 1,746,611 | 2/1930 | Schwab | 40/125 |
| 3,262,417 | 7/1966 | Zimmer | 116/282 X |
| 3,466,609 | 9/1969 | Ohlund | 340/825.72 |
| 3,475,092 | 10/1969 | Harvey | 340/825.69 X |
| 3,544,960 | 12/1970 | Hayes | 340/47 |
| 3,727,228 | 4/1973 | Taylor et al. | 340/825.69 X |
| 3,867,775 | 2/1975 | Lapham et al. . | |
| 4,581,700 | 4/1986 | Farnham et al. | 246/125 X |
| 4,894,654 | 1/1990 | Serenbetz | 340/825.72 X |
| 4,995,278 | 2/1991 | Huang | 74/89.15 |
| 5,038,704 | 8/1991 | Dean et al. | 246/477 X |

*Primary Examiner*—Michael S. Huppert
*Assistant Examiner*—Scott L. Lowe
*Attorney, Agent, or Firm*—Bull, Housser & Tupper

[57] ABSTRACT

An apparatus for representing the state of a condition, the condition having a true state and a false state, the apparatus comprising an indicator having a recognizable feature indicative of the true state of the condition, a cover for covering the indicator and a support for removably supporting the indicator and cover on a surface. The apparatus includes a device for moving the indicator and the cover relative to each other such that the true state of the condition is represented by the indicator being uncovered and the false state of the condition is represented by the indicator being covered.

14 Claims, 5 Drawing Sheets

FLAGGING APPARATUS AND METHOD

BACKGROUND OF THE INVENTION

This invention relates to signalling devices for signalling a condition to an observer and more particularly to railway signalling devices for signalling a condition of a railroad track to a train engineer situated on a train.

Generally, all railways have an authority which issues operating rules of the railway. Such rules often have specific clauses which protect workers performing track work within certain limits along railway rights-of-way during a pre-determined period of time. A typical clause is that before any work can be performed at a work site, a flagman is required to walk along the track to a location at a specified distance from the work site and physically place four flags on staffs in a position so as to be seen by train engineers on approaching trains. When the work shift is completed, the flagman is sometimes required to remove the flags. On successive days, the flagman is required to place the flags at the start of each shift and is required to remove the flags at the end of each shift. This can be time consuming for the flagman as the location of placing the flags is often a considerable distance from the work site.

What is desired therefore is a device which eliminates the task of physically placing flags at the required locations along a railroad track when work is to be performed along railway rights-of-way.

SUMMARY OF THE INVENTION

In accordance with the present invention there is provided an apparatus for representing the state of a condition, the condition having a true state and a false state. The apparatus comprises an indicator having a recognizable feature indicative of the true state of the condition, a cover for covering the indicator and a support for removably supporting the indicator and cover on a surface. The apparatus also includes a device for moving the indicator and the cover relative to each other such that the true state of the condition is represented by the indicator being uncovered and the false state of the condition is represented by the indicator being covered.

Preferably, the apparatus further includes a timer for actuating the device for moving the indicator to cause the true state to be represented for a first pre-determined period of time and for actuating the moving means to cause the false state to be represented for a second pre-determined period of time.

Also preferably, the apparatus includes an extendible shaft having first and second opposite end portions which are moveable relative to each other, the first end portion being connected to the indicator and the second end portion being connected to the cover. The device for moving the indicator preferably acts on the extendible shaft to move the first and second opposite end portions relative to each other and hence moves the indicator relative to the cover.

The device for moving the indicator may also include an electric motor operable to extend and contract the extendible shaft.

Preferably, the apparatus includes self-contained power supply means for supplying power to the electric motor.

With the present invention, the condition to be represented may be that work is being performed on the track ahead. This condition may be either true or false and thus has two possible states. These two states can be represented by the indicator of the present invention wherein the indicator is in full view of an engineer of an approaching train when the condition is true and wherein the indicator is out of view when the condition is false.

The physical placement of flags by a flagman is eliminated by the use of a timer to control the raising and retracting of the indicator and by providing the apparatus with a self-contained power supply.

Alternatively, the physical placement of flags is eliminated by using a radio signal issued by a transmitter operated by a worker at the work site, the radio signal being transmitted through the air to the apparatus located some distance away. A radio receiver in the apparatus receives the radio signal and actuates a motor to raise or lower the indicator as desired.

The timer and the radio control apparatus may be used simultaneously wherein the radio signal serves to actuate the timer into the "on" state or the "off" state as desired.

DETAILED DESCRIPTION

Figure 1:
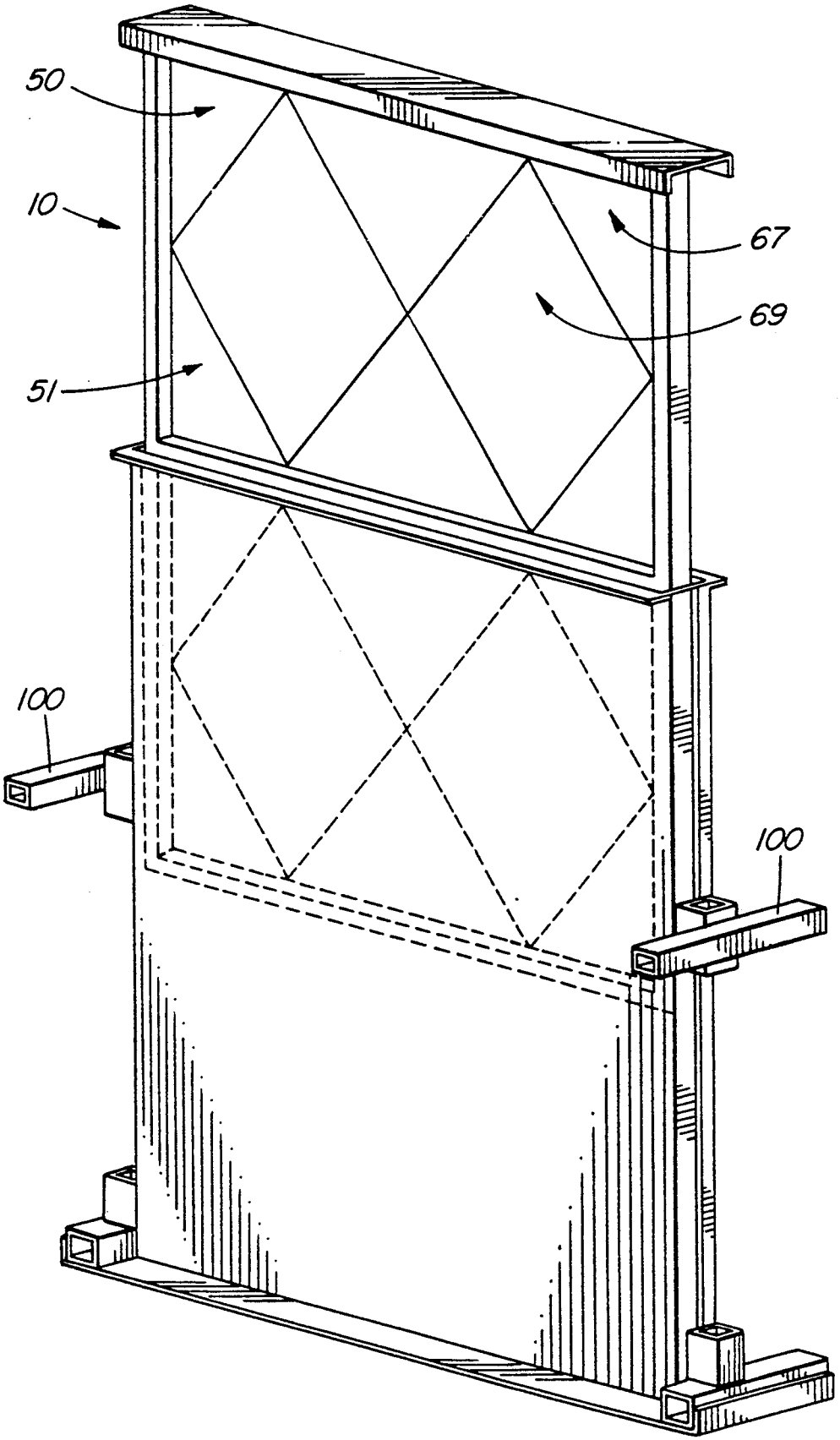
FIG. 1 is a front perspective view of an apparatus according to a first embodiment of the invention, with an indicator thereof in a raised position.

Referring to FIG. 1 an apparatus for representing a condition relating to a railroad track is shown generally at 10. By way of example, the condition may be that workmen are working on a section of railroad track immediately ahead and that proceeding further ahead on the track could be dangerous for a train on the track or could be dangerous to the workmen immediately ahead. For simplicity therefore, the condition may be thought of as "Danger Ahead". It will be appreciated that this condition has two states, namely a true state and a false state. If the condition is true, then there truly is danger ahead whereas if the condition is false then there is no danger ahead.

A train engineer having knowledge of the truth or falsity of the condition, i.e. the presence or absence of danger ahead, can make the appropriate judgement as to whether or not he should proceed on the track immediately ahead. The apparatus shown in FIG. 1 is used to indicate the truth or falsity of the condition to a train engineer and thus permits the train engineer to make judgement accordingly.

Figure 2:
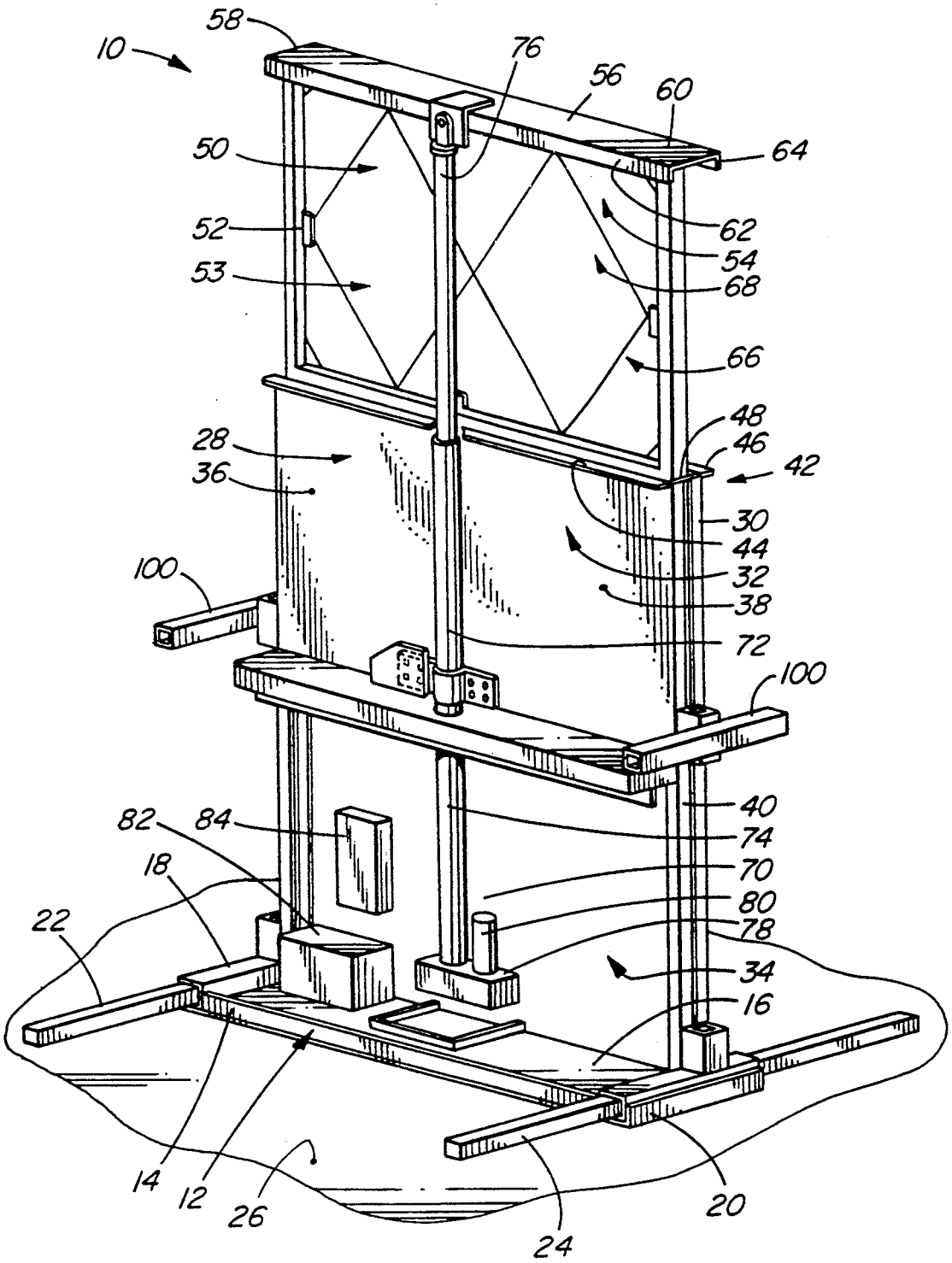
FIG. 2 is a rear perspective view of the apparatus of FIG. 1 with a component cover thereof removed.
Figure 3:
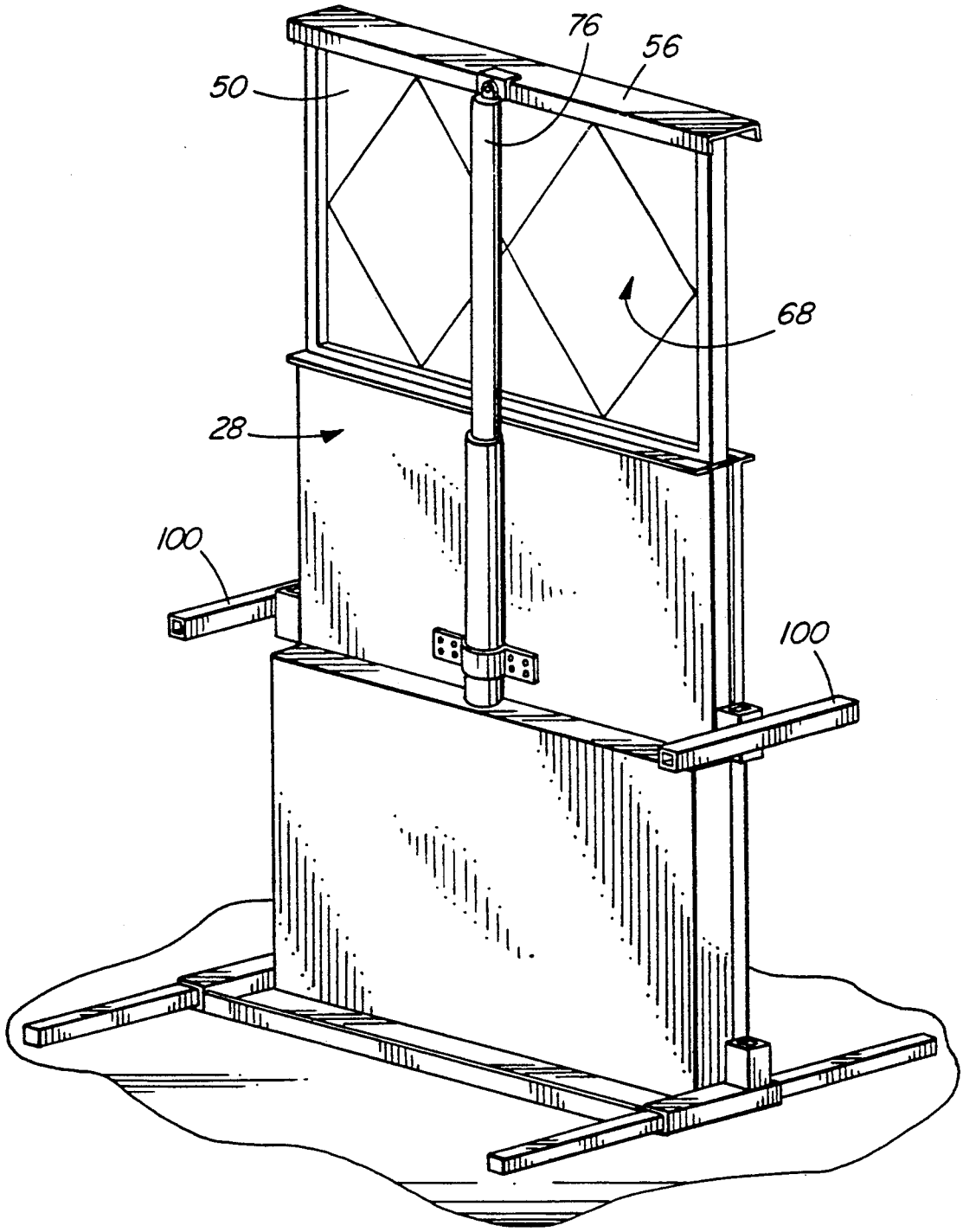
FIG. 3 is a rear perspective view of the apparatus of FIG. 2 with the component cover thereof installed.

Referring to FIG. 2, the apparatus includes a base plate 12 having first and second opposite sides 14 and 16. To the first and second opposite sides are connected first and second portions of square tubing 18 and 20 such that the portions extend transversely to the base plate and such that the portions extend parallel and spaced apart from each other. Within the first and second portions are received first and second square support members 22 and 24 respectively. The first and second square support members act as support means for supporting the apparatus on a relatively flat horizontal surface 26. This surface is provided by the ground immediately adjacent to and on one side of the train track. Thus the train can pass the apparatus situated on such surface without disturbing the apparatus, which enables the train to pass without requiring the apparatus to change its representation of the condition to permit passage of the train.

To the base member, first and second cover members 28 and 30 are secured as by welding, in an upright position such that the first and second cover members extend vertically upwards relative to the base member when the apparatus is at rest on the horizontal surface 26. The first and second cover members are disposed in parallel spaced apart relation such that a space is formed between the first and second cover members.

The first and second cover members 28 and 30 are similar in shape and function and therefore only the first cover member 28 will be described although it is to be understood that the second cover member 30 is similar.

The first cover member 28 has top and bottom portions 32 and 34 and has first and second opposite side portions 36 and 38. Generally, the first cover portion is planar with the exception of first and second transversely extending side portions, only the second transversely extending side portion being shown in FIG. 2 as indicated at 40. The first and second side portions of the first cover member abut corresponding first and second side portions of the second cover portion 30 respectively, to define the spacing between the first and second cover portions 28 and 30. Abutting side portions are connected together as by welding to form a rigid upstanding enclosure shown generally at 42.

The top portions 32 of the first and second cover portions 28 and 30 have secured thereto respective lip members 44 and 46 which extend in a plane parallel to the base member 12. The lip members extend outwardly, away from their respective cover members and provide rigidity to the respective top portions 32 of the cover portions. The lip members are parallel and spaced apart such that a slot 48 is formed between the top portions 32 of the first and second cover portions 28 and 30 respectively. The slot 48 provides access to the space between the first and second cover members 28 and 30.

An indicator 50, comprised of a rectangular frame 52 and a planar panel member 54 secured within the frame is dimensioned to be received within the slot 48 such that the indicator is operable to be received in the enclosed space between the first and second cover portions 28 and 30 such that the first and second cover portions cover the indicator 50 to conceal the indicator out of view. Such dimensioning also permits the indicator to be withdrawn from the enclosed space such that the indicator is extended relative to the first and second cover portions, wherein the first and second cover portions no longer cover the indicator and the indicator is exposed, in full view.. The indicator is thus moveable relative to the first and second cover members, with the cover members remaining fixed and the indicator moving relative thereto. The cover members, and more particularly the lip members 44 and 46, act as guiding means for guiding the indicator in linear, sliding movement between the extended position and the retracted position, to represent the true and false states of the condition respectively.

The indicator 50 also has a top member 56 which extends the length of the indicator and which has first and second end portions 58 and 60 which extend past the corresponding end portions of the indicator. The top member has first and second side portions 62 and 64 which extend parallel to the plane of the indicator such that the top member has an inverted channel shape. This inverted channel shape permits the top member to extend over the first and second lip portions 44 and 46 and to abut such portions such that said lip portions and the slot 48 between the lip portions is covered by the top member when the indicator 50 is in the retracted position. The top member 56 thus covers the slot 48, which prevents dirt, rain and other foreign material from entering the enclosed space, and prevents the indicator from extending deep inside the enclosed space as the abutment of the top member with the lip portions 44 and 46 limits the extent of retraction of the indicator into the enclosed space.

The planar panel member 54 of indicator 50 has a front side 51 shown best in FIG. 1 and a rear side 53 shown best in FIG. 2. The rear side has a planar surface 66 on which is secured an engineering grade yellow reflective panel 68. Referring to FIG. 1, the front side also has a planar surface 67 on which is secured a diamond pattern reflective panel 69. The diamond pattern acts as a recognizable feature indicative of the true state of the condition, i.e. "Danger Ahead". The recognizable feature is thus incorporated on the planar surface 67.

Referring back to FIG. 2, the apparatus further includes moving means for moving the indicator 50 relative to the first and second cover portions 28 and 30 to raise and lower the indicator. The moving means includes a linear actuator which, in this embodiment, is provided by a conventional satellite antenna positioner shown generally at 70. A suitable satellite antenna positioner is that identified as Model JGSIII available from ASTRAL COMMUNICATIONS of Coquitlam, British Columbia, CANADA.

The positioner used in this embodiment has an extendible shaft 72 having a first fixed portion 74 and a second extendible portion 76. The first fixed portion 74 acts as a first end portion of the extendible shaft and is fixed to a mounting member, which in this embodiment, includes a gear casing 78 mounted to the base plate 12. The second extendible portion 76 acts as a second opposite end portion to the first fixed end portion and is secured to the top member 56 of the indicator 50.

The second extendible portion 76 is moveable, in a telescoping arrangement relative to the first fixed portion 74, such that when the second extendible portion is fully extended relative to the first fixed portion, the indicator 50 is fully exposed and the diamond pattern reflective panel 69 of FIG. 1, is in full view of a train engineer. Conversely, when the second extendible member is fully retracted relative to the first fixed portion, the indicator is fully retracted and the reflective panel 69 is not visible to a train engineer.

Referring back to FIG. 2, the moving means further includes an electric motor shown generally at 80 which cooperates with a conventional gearing mechanism (not shown) of the satellite antenna positioner to extend and retract the second extendible portion 76 relative to the first fixed portion 74. It will be appreciated that the satellite antenna positioner used in this embodiment has built-in limit switches which act to prevent further actuation of the motor when the second extendible portion reaches an extension or retraction limit of its stroke. Thus, actuation of the motor causes the indicator to be extended or retracted relative to the first and second cover portions 28 and 30.

Power for the motor is supplied by a pair of conventional 12 Volt sealed lead-acid batteries 82, wired in series to provide a 24 Volt DC supply for the operation of the electrical components of the apparatus. Alternatively a solar panel (not shown) may be used to supply the necessary power.

Control of power supplied to the motor for actuation thereof is accomplished through the use of a conventional 24-Volt, 24-Hour timer 84, for example, Model BD1941203 available from Davis Controls of Edmonton, Alberta. The timer has conventional means for pre-defining the start and duration of an "ON" time period and for pre-defining the start and duration of an "OFF" time period.

Figure 5:
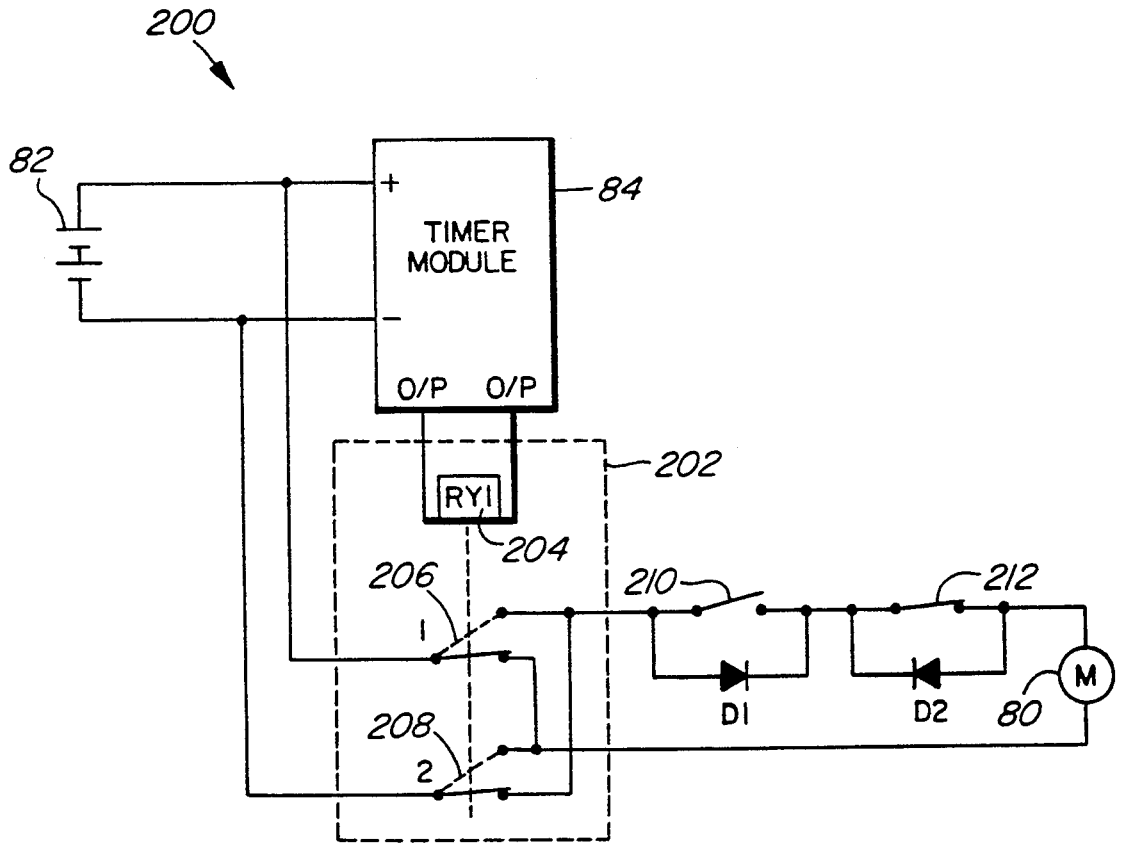
FIG. 5 is a schematic diagram of a control circuit according to the first embodiment of the invention.

Referring to FIG. 5, the apparatus includes a control circuit 200 for controlling the operation of the electric motor 80 of the satellite antenna positioner. The control circuit includes the batteries 82 and a timer 84 and further includes a relay 202 having a coil 204 and contacts 206 and 208. The control circuit further includes lower limit switch 210, a first diode D1, an upper limit switch 212 and a second diode D2. The lower and upper limit switches 210 and 212 are integral with the satellite antenna positioner, only the contacts thereof being physically accessible by a user of the device.

When the second extendable portion is retracted, the upper limit switch is closed. When the timer "ON" time is reached, the relay coil 204 is energized at which time contacts 206 and 208 move to an upper position shown in broken outline in FIG. 5. In this position, current flows from the batteries through diode D1 and through the upper limit switch 212 to supply power to the motor 80. The motor 80 powers the conventional gearing mechanism to extend the second extendable portion 76 shown in FIG. 2 relative to the first fixed portion 74 until the upper limit switch 212 shown in FIG. 5 is tripped. Tripping of the upper limit switch opens the circuit supplying power to the motor 80 and hence the motor 80 shuts off. The extendible portion 76 remains extended, in which position the true state of the condition is represented. When the second extendable portion is extended, the lower limit switch is closed.

When the timer "OFF" time is reached, power is no longer supplied to the relay coil 204 in which case the relay coil is de-energized and contacts 206 and 208 revert back to the position shown in solid outline in FIG. 5. In this position, the polarity of the voltage supplied to the motor is reversed and the path of current flow is completed by passing through motor 80, diode D2, and passing through lower limit switch 210 back to the battery. This provides power to the motor 80, at reversed polarity, which causes the motor to rotate the conventional gearing mechanism in the opposite direction whereupon the extendible portion 76 is retracted relative to the first fixed portion 74 shown in FIG. 2. Retraction of the second extendible portion 76 continues until the lower limit switch is tripped at which time the control circuit is opened and power to the motor 80 is interrupted. When the extendable portion is retracted, the false state of the condition is represented.

In effect therefore, the timer 84 is for actuating the moving means to cause the true state of the condition to be represented for a first pre-determined period of time and is for actuating the moving means to cause the false state of the condition to be represented for a second pre-determined period of time. In this embodiment, the "ON" state of the timer corresponds to the first pre-determined period of time, while the "OFF" state corresponds to the second pre-determined period of time.

Figure 4:
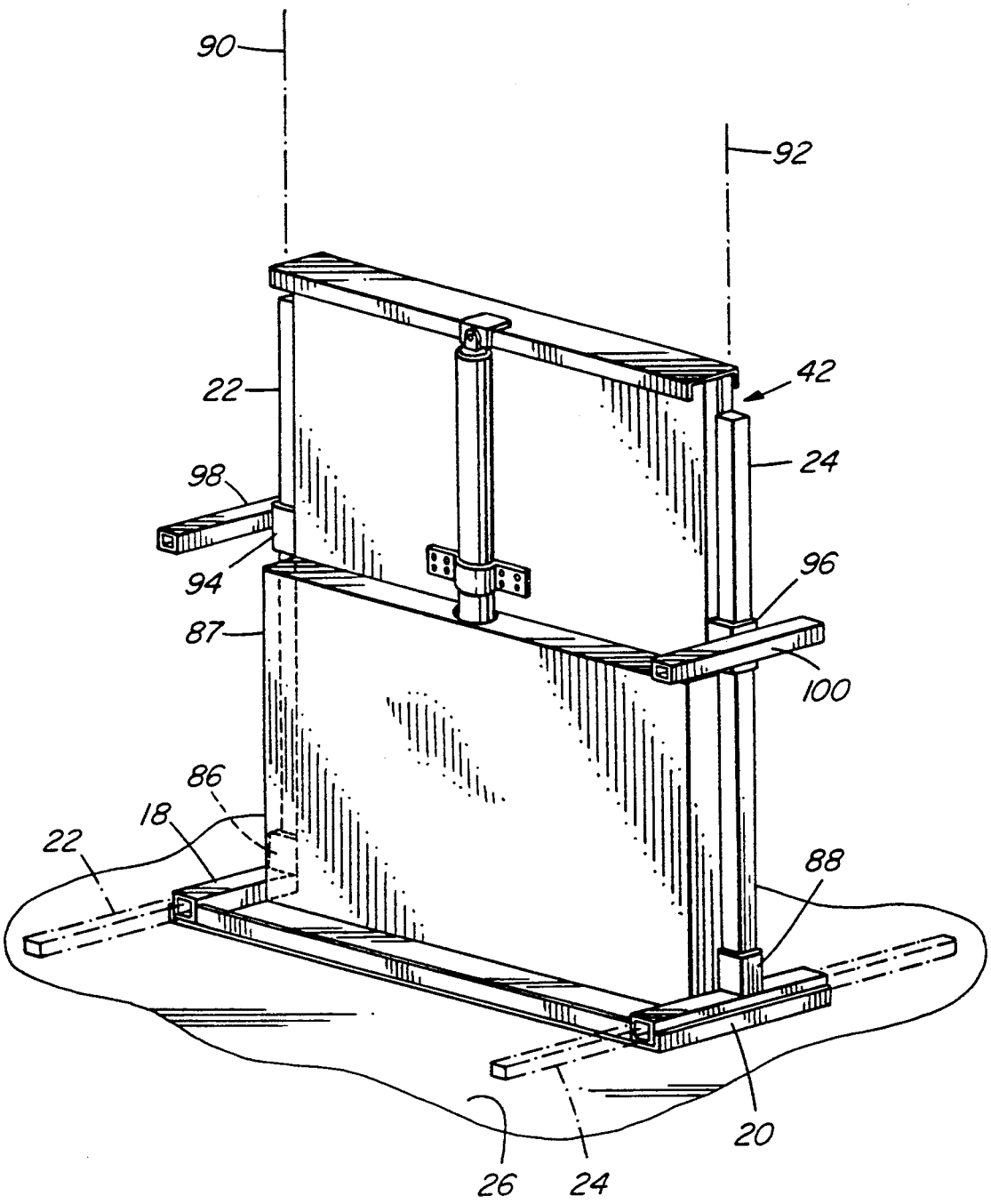
FIG. 4 is a rear perspective view of the apparatus of FIG. 3 with the indicator thereof shown in a retracted position.

Referring now to FIG. 4, the apparatus further includes a component cover 87 for covering the timer, batteries and satellite positioner and includes and third and fourth portions of square tubing 86 and 88 which are similar to the first and second portions of square tubing 18 and 20. The third and fourth portions are secured to respective opposite side portions of the enclosure 42, perpendicular to the first and second portions 18 and 20, and in an orientation in which respective longitudinal axes 90 and 92 of the third and fourth portions are parallel to the side portions of the enclosure.

Approximately half way along the side portions of the enclosure 42, fifth and sixth portions of square tubing 94 and 96 are secured to the enclosure such that the axes of the fifth and sixth portions are in longitudinal alignment with the axes 90 and 92 of the third and fourth tubular portions respectively. This permits the support members 22 and 24 to be inserted into the third and fifth 86 and 94 and into the fourth and sixth 88 and 96 tubular members respectively, such that the support members are placed in a storage position in which the support members lie in a common plane. When the support members are in this position, the apparatus has a narrow profile which facilitates easy stacking of a plurality of similar apparatuses.

The apparatus also has seventh and eighth tubular portions 98 and 100 which are secured to the fifth and sixth tubular portions 94 and 96 such that the seventh and eighth portions 98 and 100 are disposed in parallel spaced apart relation relative to the first and second tubular portions 18 and 20. The seventh and eighth tubular portion 98 and 100 in this position are conveniently used as carrying handles for carrying the apparatus from a warehouse or storage area to a truck or for carrying the apparatus to a location near a railroad track at which the apparatus will perform its functions.

OPERATION

The apparatus is stacked and transported in the position shown in FIG. 4. Tubular portions 98 and 100 are conveniently used to carry the apparatus to a location near a railroad track.

When a location is chosen, the apparatus is set on the surface 26 such that the first and second tubular portions 18 and 20 contact the surface. The apparatus is then supported by an operator's hand while the first and second support members 22 and 24 are removed from the storage position shown in FIG. 4 and are placed in the usage position shown in broken outline in FIG. 4.

The component cover 87 is then removed to expose the batteries, timer and satellite positioner as shown in FIG. 2. The timer 84 is then set to recognize the present time of day and to recognize the starting times and durations of the pre-defined "ON" period and the pre-defined "OFF" period. Depending upon these settings, the indicator may be raised or lowered in accordance with the current state of the timer. The cover 87 is then placed back on the apparatus as shown in FIG. 4 and the apparatus may be left unattended.

As an example of setting the timer, suppose that the apparatus is to be used to signal a train engineer that workmen are working on the track ahead. The workmen typically work an 8-hour day which begins at 8:00 am and which ends at 4:00 pm. Thus, the track must remain closed to train traffic between the hours of 8:00 am and 4:00 pm and may be open to traffic between the hours of 4:00 pm and 8:00 am the following day, depending upon the nature of the work being done on the track.

In the above scenario, the timer would be set to raise the indicator at 8:00 am and to retract the indicator at 4:00 pm each day. Thus, the first pre-determined time, corresponding to the time during which the indicator is in full view, would be 8 hours while the second pre-determined time, corresponding to the time during which the indicator is retracted would be 16 hours. With the timer ensuring that the indicator is raised and lowered at the appropriate times each day, a flagman need not attend to the apparatus until the work on the track is completed, perhaps at the end of the week. Thus, repeated setting and removal of flags each day is eliminated.

ALTERNATIVES

In an alternative embodiment the timer is replaced with actuating means responsive to a remotely controlled signal for actuating the moving means. The remotely controlled signal may be issued by a signalling device similar to a radio controlled model airplane controller and may be issued on a frequency similar to that used by such controller. Thus, communication between the signalling device and the actuating means is wireless, requiring no physical connection between the signalling device and the actuating means. In this embodiment, the actuating means includes a radio receiver which receives the remotely controlled signal and actuates the motor to raise or lower the indicator accordingly.

Alternatively, the remotely controlled signal may be an ultrasonic signal or a laser generated signal and the receiver may be receptive to such signals accordingly.

The present invention permits a self contained signalling apparatus to be supported on a surface adjacent a railroad track without interfering with the operation of the railroad. Furthermore, the signalling apparatus can be used to represent the true or false state of a condition without interfering with the operation of the railroad.

Using the embodiment of the invention which employs the timer, the apparatus can be set up and left unattended for long periods of time, or at least until the batteries are depleted.

Using the embodiment of the invention which employs the radio receiver, the apparatus can be set up and controlled remotely. For example, the workmen arriving at the worksite at 8:00 am can send a radio control signal which will cause the indicator to be raised, thereby indicating the true state of the condition, or in other words, that there is danger ahead. Similarly, workmen leaving the worksite at 4.00 pm can send a radio control signal which will cause the indicator to be lowered, thereby indicating the false state of the condition, or in other words, that there is no danger ahead.

The present invention eliminates the need for a flagman to physically place and remove flags each time a shift is started and ended. Furthermore, danger indicators at opposite positions on the railway, for example, one mile north of the worksite and one mile south of the worksite can be raised simultaneously and thus the work site can be protected from both directions on the track simultaneously. This was previously not practical because, often, as exemplified by the example above, indicators signalling in opposite directions on the track may be miles apart and one flagman would be required to set the flags at both locations. The travel time of the flagman walking between locations prevented flags at both locations from being set simultaneously. During the travel time, workers at the worksite would only be protected from trains approaching from one direction. The safety of workers was therefore somewhat at risk.

The present invention, however, permits flags at both locations to be set simultaneously. The present invention therefore also increases the safety of the workers at the work site. Work can begin virtually immediately upon arriving at the job site because the indicators signalling in each direction can be raised immediately upon arrival at the worksite.

While the invention has been disclosed as having a preferred design, it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention of the limits of the appended claims.

What is claimed is:

1. An apparatus for representing the state of a condition, the condition having a true state and a false state, the apparatus comprising:

a) an indicator having a recognizable feature indicative of the true state of the condition;

b) a cover for covering the indicator;

c) moving means for moving the indicator relative to the cover such that the true state of the condition is represented by the indicator being uncovered and the false state of the condition is represented by the indicator being covered;

d) support means for removably supporting the indicator and cover on a surface, the support means including:

i) first and second support members removably connectable to the cover in a usage position such that the cover is held in an upright position, the first and second support members being operable to lay on the surface in parallel spaced apart relation and having sufficient length and being spaced apart sufficiently to prevent the cover from being toppled from the upright position;

ii) first and second holders on the cover, for holding the first and second support members in the usage position; and iii) third and fourth holders for holding the first and second support members in a storage position in which the support members and cover lie in a common plane.

2. An apparatus as claimed in claim 1 further including a timer for actuating the moving means to cause the true state to be represented for a first pre-determined period of time and for actuating the moving means to cause the false state to be represented for a second pre-determined period of time.

3. An apparatus as claimed in claim 1 wherein the cover includes an enclosure for enclosing the indicator when the indicator is representing the false state of the condition.

4. An apparatus as claimed in claim 1 wherein the indicator moves linearly relative to the cover.

5. An apparatus as claimed in claim 1 wherein the indicator cooperates with the cover for sliding movement relative thereto, the cover guiding the indicator during movement thereof.

6. An apparatus as claimed in claim 1 wherein the moving means includes an extendible shaft having first and second opposite end portions which are moveable relative to each other, the first end portion being connected to the indicator and the second end portion being connected to the cover.

7. An apparatus as claimed in claim 6 wherein the moving means includes an electric motor operable to extend and contract the extendible shaft.

8. An apparatus as claimed in claim 7 further including self-contained power supply means for supplying power to the electric motor.

9. An apparatus as claimed in claim 8 wherein the self-contained power supply means includes a battery.

10. An apparatus as claimed in claim 1 further including actuating means responsive to a remotely controlled signal for actuating the moving means, the remotely controlled signal having an active state and an inactive state, the moving means being actuated when the remotely controlled signal is rendered active.

11. An apparatus as claimed in claim 10 wherein the remotely controlled signal is a wireless signal and wherein the actuating means includes a wireless signal receiver for receiving the wireless signal.

12. An apparatus as claimed in claim 11 wherein the remotely controlled signal is a radio frequency signal and wherein the actuating means includes a radio frequency receiver for receiving the radio frequency signal.

13. An apparatus as claimed in claim 1 wherein the indicator includes a member having a planar surface, the recognizable feature being incorporated on the planar surface.

14. An apparatus as claimed in claim 13 wherein the recognizable feature includes a colour reflective material on the planar surface.

* * * * *